US008813425B2

(12) United States Patent
Ash, Jr. et al.

(10) Patent No.: US 8,813,425 B2
(45) Date of Patent: Aug. 26, 2014

(54) MOVABLE PANEL ASSEMBLY WITH A POWER SLIDING DRIVE MECHANISM

(71) Applicant: Pilkington Group Limited, Nr. Ormskirk (GB)

(72) Inventors: Charles E. Ash, Jr., Perrysburg, OH (US); Shane C. Seiple, Perrysburg, OH (US)

(73) Assignee: Pilkington Group Limited, Lathom (GB)

( * ) Notice: Subject to any disclaimer, the term of this patent is extended or adjusted under 35 U.S.C. 154(b) by 0 days.

(21) Appl. No.: 13/848,779

(22) Filed: Mar. 22, 2013

(65) Prior Publication Data

US 2013/0255158 A1 Oct. 3, 2013

Related U.S. Application Data

(60) Provisional application No. 61/616,002, filed on Mar. 27, 2012.

(51) Int. Cl.
*E06B 1/00* (2006.01)

(52) U.S. Cl.
USPC ..... 49/380

(58) Field of Classification Search
USPC ..... 49/380, 116, 118, 123, 413, 327, 331, 49/332
See application file for complete search history.

(56) References Cited

U.S. PATENT DOCUMENTS 4,561,224 A 12/1985 Jelens
4,995,195 A * 2/1991 Olberding et al. ..... 49/118
5,694,717 A 12/1997 Gier
5,724,769 A 3/1998 Cripe
5,784,833 A * 7/1998 Sponable et al. ..... 49/360
5,822,922 A * 10/1998 Grumm et al. ..... 49/360
5,836,110 A * 11/1998 Buening ..... 49/360
6,014,840 A 1/2000 Ray
6,021,605 A * 2/2000 Laux et al. ..... 49/361
6,026,611 A * 2/2000 Ralston et al. ..... 49/123
6,119,401 A 9/2000 Lin
6,207,911 B1 3/2001 Hirsch
6,324,788 B1 12/2001 Koneval
6,435,636 B1 8/2002 MacMillan
6,766,617 B2 7/2004 Purcel
6,955,009 B2 10/2005 Rasmussen
7,003,916 B2 * 2/2006 Nestell et al. ..... 49/413
7,025,405 B2 4/2006 Gillen
7,073,293 B2 7/2006 Galer
7,464,501 B2 * 12/2008 Arimoto et al. ..... 49/413
7,584,574 B2 * 9/2009 Kinross et al. ..... 49/413
7,641,265 B2 1/2010 Seiple (Continued)

*Primary Examiner* — Jerry Redman
(74) *Attorney, Agent, or Firm* — Marshall & Melhorn, LLC

(57) ABSTRACT

A powered sliding drive assembly is provided with a sliding panel having a frame member on its periphery and guide pins that are on the bottom of the sliding panel. The pins may have a washer and/or a collar disposed on them. The washers provide quiet movement of the sliding pane. The sliding panel defines a plane. The assembly further has two or more cables, each of which is separately attached on one end to opposite sides of the frame member, pins, washers, and/or collars, where each of these ends of the cables is in the plane of the sliding panel. Each cable is attached on another end to opposite sides of a drive unit. The pins of the sliding panel are positioned in tracks, whereby the sliding panel can be located in a flush-flush position with a fixed panel and a vehicle body panel.

23 Claims, 10 Drawing Sheets

(56) References Cited

U.S. PATENT DOCUMENTS

| | | | | |
|---|---|---|---|---|
| 7,673,419 | B2 * | 3/2010 | Arimoto | 49/380 |
| 7,735,897 | B2 | 6/2010 | Seiple | |
| 7,789,450 | B2 | 9/2010 | Seiple | |
| 8,024,893 | B2 | 9/2011 | Gillen | |
| 8,151,519 | B2 * | 4/2012 | Bello et al. | 49/380 |
| 8,510,993 | B2 * | 8/2013 | Mellary et al. | 49/380 |
| 8,578,654 | B2 * | 11/2013 | Rao et al. | 49/413 |
| 2003/0188487 | A1 * | 10/2003 | Rasmussen | 49/116 |
| 2004/0020131 | A1 * | 2/2004 | Galer et al. | 49/413 |
| 2006/0032140 | A1 * | 2/2006 | Arimoto et al. | 49/209 |
| 2010/0071270 | A1 * | 3/2010 | Seiple et al. | 49/413 |
| 2010/0263290 | A1 * | 10/2010 | Pawloski et al. | 49/413 |
| 2010/0263291 | A1 * | 10/2010 | Bello et al. | 49/413 |
| 2013/0283693 | A1 * | 10/2013 | Huizen et al. | 49/123 |

* cited by examiner

MOVABLE PANEL ASSEMBLY WITH A POWER SLIDING DRIVE MECHANISM

RELATED APPLICATION

This application claims the benefit under 35 U.S.C. §119 (e) of U.S. Provisional Patent Application Ser. No. 61/616,002, filed Mar. 27, 2012, which is incorporated by reference herein in its entirety.

FIELD OF THE INVENTION

The present invention relates to a movable panel assembly with a power sliding drive mechanism. More particularly, the present invention relates to a movable panel assembly with a power sliding drive mechanism for a flush-flush closing vehicle sliding panel.

BACKGROUND OF THE INVENTION

Pickup trucks and other related vehicles have a rear window, or backlite, that is mounted in a vehicle body aperture, immediately behind the seats in the vehicle passenger compartment. Many of the backlites are built with one or two slider panels that ride in slider tracks, while opening or closing across a portion of a window aperture.

The slider panels may be moved manually or automatically across the window aperture. When automatically driven, the slider panels may be moved by a window regulator, for example, like that disclosed in U.S. Pat. No. 6,119,401 to Lin (hereinafter Lin).

For the Lin device, there is a cable having a powered regulator attached to one cable end and a carrier block that is physically attached at another cable end, wherein the carrier block has a female carrier socket. In conjunction with the carrier block, an attachment block is rigidly mounted to a slidable window pane, wherein the attachment block has a male engagement stud that is loosely disposed within the female carrier socket. Consequently, when the Lin window regulator is powered for movement of the cable, the carrier socket and the engagement stud come into mating engagement that results in sliding movement of the slidable window pane. Such an arrangement is noisy, where the powered window regulator loosely drives the slidable window pane. Because of the many parts involved, the Lin window regulator has high material and labor costs.

Some slider assemblies are further designated as being flush where a sliding panel is in the plane of the fixed panel(s), when the sliding panel completely closes the backlite opening, or the complete window assembly may be in the plane of a vehicle body panel. Various ways to achieve flush orientation to fixed panels are, for example, by utilizing guide pins, ramps, and cams to move the sliding panel into the backlite opening.

An example of a horizontal sliding assembly that moves its sliding panel into the plane of a fixed panel, when the sliding panel completely closes the backlite opening, is U.S. Pat. No. 4,561,224 to Jelens (hereinafter, Jelens), which teaches a sliding window assembly having opposed longitudinally spaced first and second guide pins on the top and bottom of a slidable window that are adapted for sliding motion within corresponding first and second tracks respectively, as shown, for example, in Jelens' FIGS. 2-5 and 7.

Even further, some sliding assemblies are designated as being flush-flush, wherein the sliding panel is not only flush within the sliding assembly itself (i.e., the sliding panel being in the same plane as fixed panels) but the sliding assembly would also be in the same plane as an outer vehicle body panel. U.S. Pat. No. 7,641,265 to Seiple (hereinafter Seiple) is an example of a flush-flush sliding assembly, which is incorporated herein by reference in its entirety.

What is sought is a powered sliding assembly that directly, smoothly, and with less resistance drives a sliding panel with little noise. While achieving these benefits, it is desired for such a powered sliding assembly to be simple in design, thereby having few parts in order to reduce material and labor costs. Such a sliding assembly should also be capable of being flush-flush in design.

SUMMARY OF THE INVENTION

A powered sliding drive assembly is provided having a fixed panel that defines a window opening, a sliding panel that is movable between a closed position covering the window opening and an open position. The sliding panel has a frame member secured around at least a portion of the periphery of the sliding panel, wherein the sliding panel defines a plane. The powered sliding drive assembly also has at least one guide pin extending substantially vertically downwardly from a portion of the frame member, which is disposed on a bottom portion of the sliding panel. There is also at least one cable connected at a first end to the guide pin, to the frame member, or to both, and a second end connected to a sliding panel drive unit. As a result, at least the first end of the cable is in the plane of the sliding panel.

The powered sliding drive assembly may further be provided with at least one track, wherein the sliding panel has at least one pin positioned in the track and the sliding panel is located in a flush-flush position with a fixed panel and a vehicle body panel. The pin may also have a washer disposed on it, thereby providing smooth and quiet movement of the sliding panel.

Further objects and advantages of the present invention will be apparent from the following description and appended claims, reference being made to the accompanying drawings forming a part of a specification, wherein like reference characters designate corresponding parts of several views.

DESCRIPTION OF THE INVENTION

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions, directions or other physical characteristics relating to the embodiments disclosed are not to be considered as limiting, unless the claims expressly state otherwise.

Figure 1:
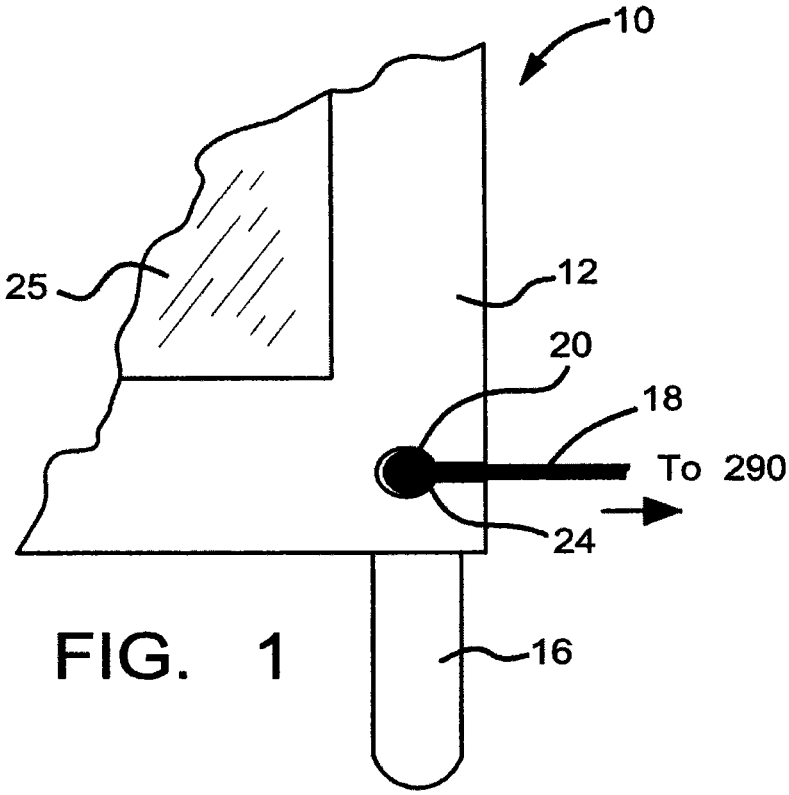
FIG. 1 is an elevation view of a bottom corner of a sliding panel with a frame, pin, and cable that is disposed within the frame in accordance with the present invention.
Figure 15:
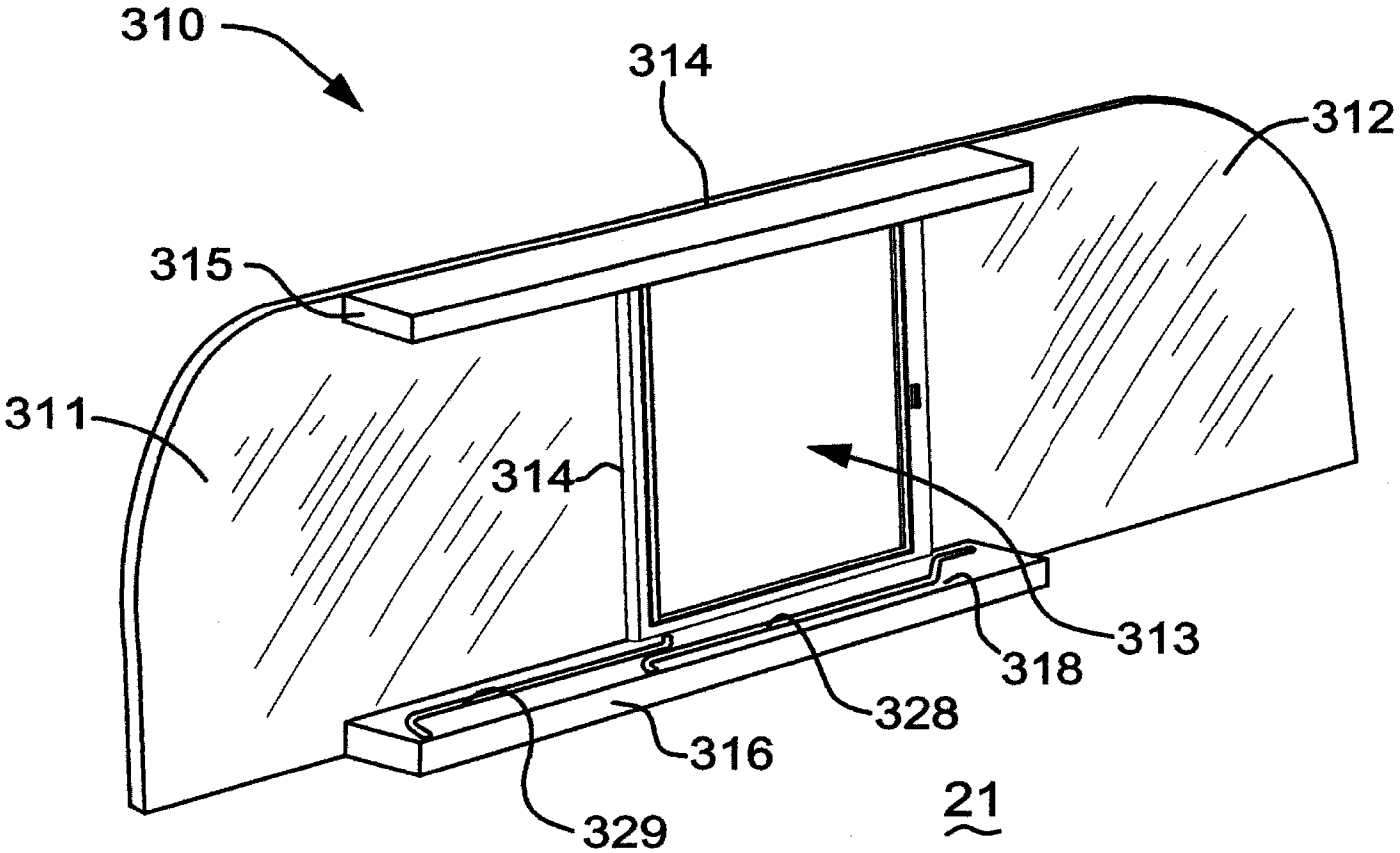
FIG. 15 PRIOR ART
FIG. 15 is a perspective view of a prior art sliding window assembly having two fixed panels and a track.

FIG. 1 illustrates a bottom corner of a sliding panel assembly 10 having a frame 12, pin 16, and cable 18, where the cable 18 is disposed in the frame 12, as viewed from within a vehicle compartment 21 (see FIG. 15). The cable 18 has a bead 20 intimately connected on an end thereof, the bead 20 being disposed within a cavity 24 of the frame 12. The sliding panel assembly 10 also comprises a sliding panel 25, which together with the frame 12 defines a plane. All fixed panels or sliding panels of the present invention may comprise glass or plastic, but preferably glass. These fixed panels or sliding panels may at least be transparent or translucent. As indicated by the right pointing arrow, the bead 20 cooperates with the cavity 24 to allow for smooth and quiet pulling of the sliding panel assembly 10 to the right by the cable 18, which is attached to a drive unit 290 (see FIG. 13).

Although the cable 18 and bead 20 are shown in a preformed cavity in the frame 12 in FIG. 1, these items 18, 20 could be molded into the frame 12 and yet the invention would function the same as described above. This applies to all cables with beads for the present invention. The cable 18 is in the plane of the sliding panel 25 and frame 12.

Figure 2:
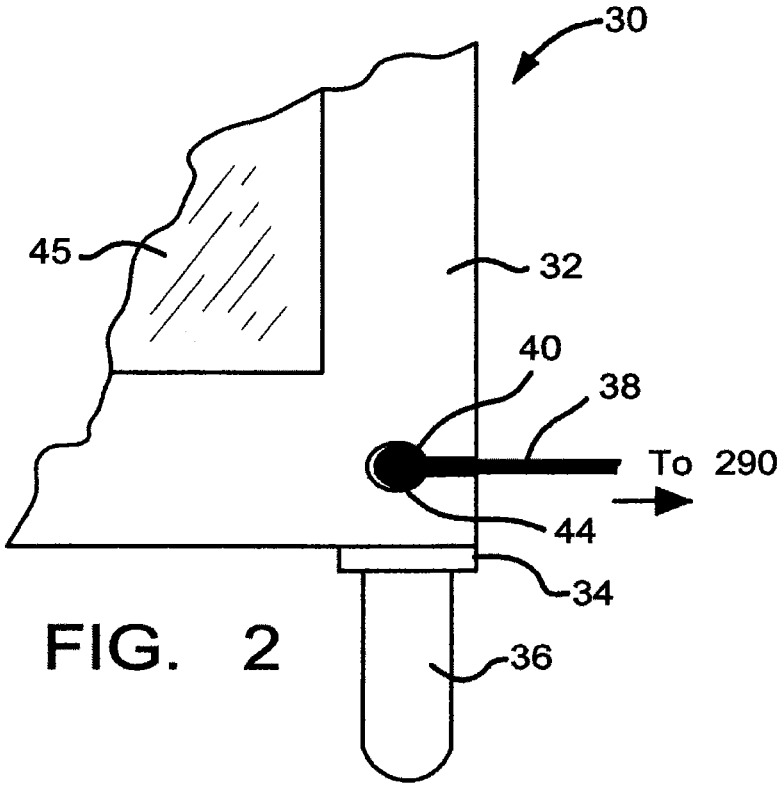
FIG. 2 is an elevation view of a bottom corner of a sliding panel with a frame, washer, pin, and cable that is disposed within the frame in accordance with the present invention.

FIG. 2 illustrates a bottom corner of a sliding panel assembly 30 having a frame 32, shoulder or washer 34, pin 36, and cable 38 that is disposed in the frame 32. The cable 38 has a bead 40 intimately disposed on an end thereof, the bead 40 being disposed within a cavity 44 that is defined within the frame 32. The sliding panel assembly 30 also comprises a sliding panel 45, which together with the frame 32 defines a plane.

Functionally, with the washer 34 disposed about a top of the pin 36, the bead 40 cooperates with the cavity 44 and the washer 34, which is disposed onto the frame 32 at the top of the pin 36, to smoothly and quietly allow for pulling the sliding panel assembly 30 to the right (as indicated by the right pointing arrow) by the cable 38, which is attached to the drive unit 290. The cable 38 is in the plane of the sliding panel 45 and frame 32.

Figure 3:
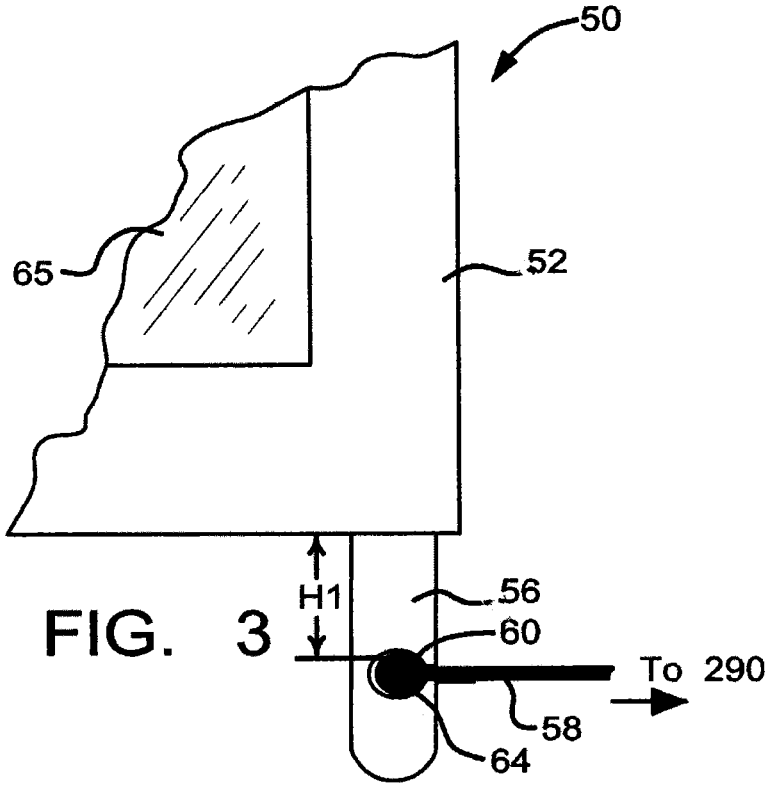
FIG. 3 is an elevation view of a bottom corner of a sliding panel with a frame, pin, and cable that is disposed within the pin in accordance with the present invention.

FIG. 3 illustrates a bottom corner of a sliding panel assembly 50 having a frame 52, pin 56, and cable 58 that is disposed in the pin 56. The cable 58 has a bead 60 intimately disposed on an end thereof, the bead 60 being disposed within a cavity 64 that is defined within the pin 56. The sliding panel assembly 50 also comprises a sliding panel 65, which together with the frame 52 defines a plane. The bead 60 cooperates with the cavity 64 to smoothly allow for pulling the sliding panel assembly 50 to the right (as indicated by the right pointing arrow in the figures) by the cable 58, which is attached to the drive unit 290.

In FIG. 3, a dimension H1 represents a clearance necessary between the bottom of the frame 52 and the cable, so that the cable 58 does not interfere with a track (see, for example, tracks 282, 284 of FIG. 14) during the cable's operation of pulling the sliding panel assembly 50. Similarly, the clearance H1 is present in the embodiment of FIG. 5. The cable 58 is in the plane of the sliding panel 65 and frame 52.

Figure 4:
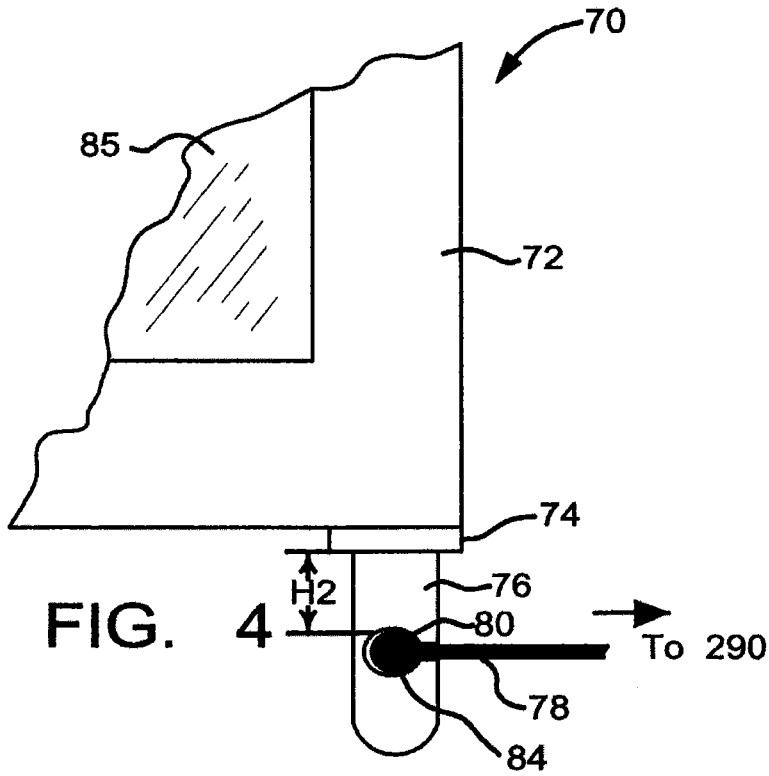
FIG. 4 is an elevation view of a bottom corner of a sliding panel with a frame, washer, pin, and cable that is disposed within the pin in accordance with the present invention.

FIG. 4 illustrates a bottom corner of a sliding panel assembly 70 having a frame 72, shoulder or washer 74, pin 76, and cable 78 that is disposed in the pin 76. The cable 78 has a bead 80 intimately disposed on an end thereof, the bead 80 being disposed within a cavity 84 that is defined within the pin 76. The sliding panel assembly 70 also comprises a sliding panel 85, which together with the frame 72 defines a plane. The bead 80 cooperates with the cavity 84 and the washer 74, which is disposed about the top of the pin 76, to smoothly allow for pulling the sliding panel assembly 70 to the right (as indicated by the right pointing arrow) by the cable 78, which is attached to the drive unit 290.

In FIG. 4, a dimension H2 represents the clearance necessary between the bottom of the washer 74 and the cable 78, so that the cable 78 does not interfere with a track (see, for example, tracks 282, 284 of FIG. 14) during the cable's operation of pulling the sliding panel assembly 70. Similarly, the clearance H2 is present in the embodiment of FIG. 6. The cable 78 is in the plane of the sliding panel 85 and frame 72.

Figure 5:
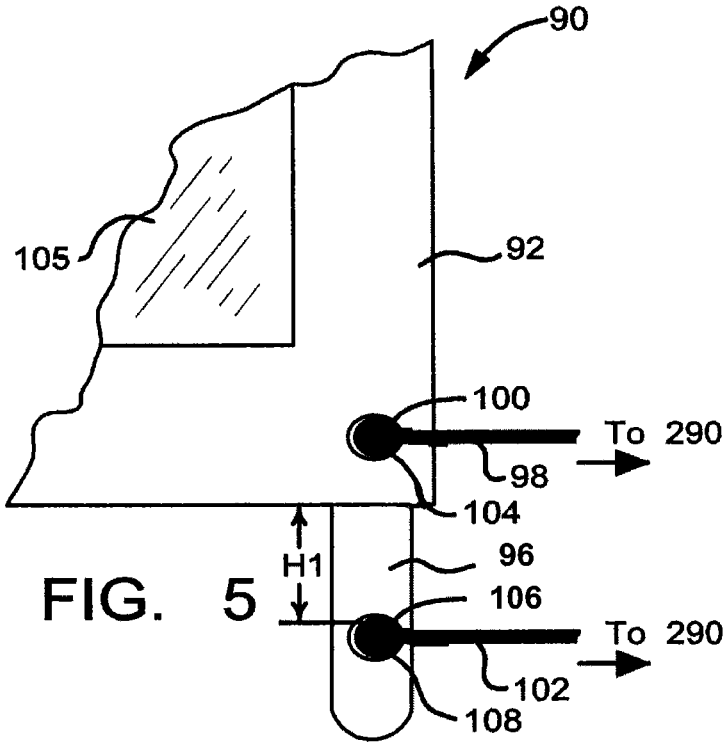
FIG. 5 is an elevation view of a bottom corner of a sliding panel with a frame, pin, and two cables where one cable is disposed within the frame and the other cable is disposed within the pin in accordance with the present invention.

FIG. 5 illustrates a bottom corner of a sliding panel assembly 90 having a frame 92, pin 96, and cables 98, 102 that are respectively disposed in the frame 92 and pin 96. The sliding panel assembly 90 also comprises a sliding panel 105, which together with the frame 92 defines a plane. The cables 98, 102 respectively have beads 100, 106 intimately disposed on an end thereof, the beads 100, 106 being respectively disposed within cavities 104, 108 that are respectively defined within the frame 92 and pin 96. The cables 98, 102 are in the plane of the sliding panel 105 and frame 92.

It should be noted that although the cable 98 is shown in a low vertical position on the frame, the present invention is not limited to a cable (e.g., 98, 118, 222, 242) at this vertical position along the edge of the frame 92. In fact, the cable 98 could be located at the upper edge of the frame 92. Selectively locating the frame cables of the instant invention anywhere along the vertical edge of a frame or, for that matter, the top pins (e.g., 276*a,b* of FIG. 14) applies to all embodiments of the present invention, where the cables 18, 38, 98, 118, 138, 222, 242, 278*c,d*, are attached directly to their corresponding frames 12, 32, 92, 112, 132, 212, 232, 272.

The beads 100, 106 respectively cooperate with the cavities 104, 108 to more smoothly allow for pulling the sliding panel assembly 90 to the right (as indicated by the right pointing arrows), by the cables 98, 102 which are attached to the drive unit 290, via pulleys 292, 294. It has herein been found that by utilizing both cables 98, 102 in such a manner provides a more uniform and balanced pull force on the sliding panel assembly 90.

Figure 6:
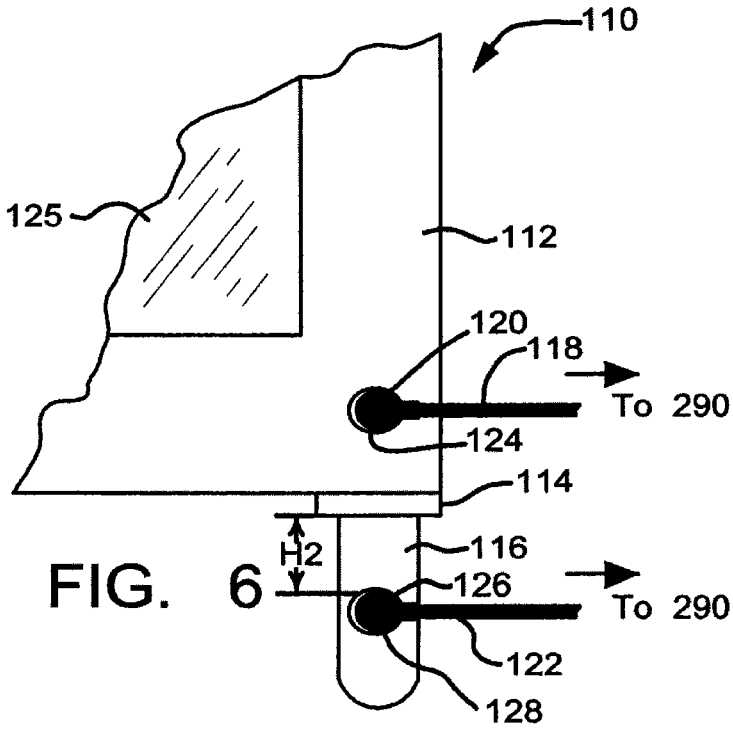
FIG. 6 is an elevation view of a bottom corner of a sliding panel with a frame, pin, washer, and two cables where one cable is disposed within the frame and the other cable is disposed within the pin in accordance with the present invention.

FIG. 6 illustrates a bottom corner of a sliding panel assembly 110 having a frame 112, shoulder or washer 114, pin 116, and cables 118, 122 that are respectively disposed in the frame 112 and pin 116. The washer 114 disposed onto the frame 112 at the top of the pin 116. The sliding panel assembly 110 also comprises a sliding panel 125, which together with the frame 112 defines a plane. The cables 118, 122 respectively have beads 120, 126 intimately disposed on an end thereof, the beads 120, 126 being respectively disposed within cavities 124, 128 that are respectively defined within the frame 112 and pin 116. The cables 118, 122 are in the plane of the sliding panel 125 and the frame 112.

The beads 120, 126 respectively cooperate with the cavities 124, 128 to more smoothly allow for pulling the sliding panel assembly 110 to the right (as indicated by the right pointing arrows) by the cables 118, 122 which are attached to the drive unit 290 and pulleys 292, 294, because it has been found that conjunctively utilizing both cables 118, 122 in this manner provides a more uniform and balanced pull force on the sliding panel assembly 110.

Figure 7:
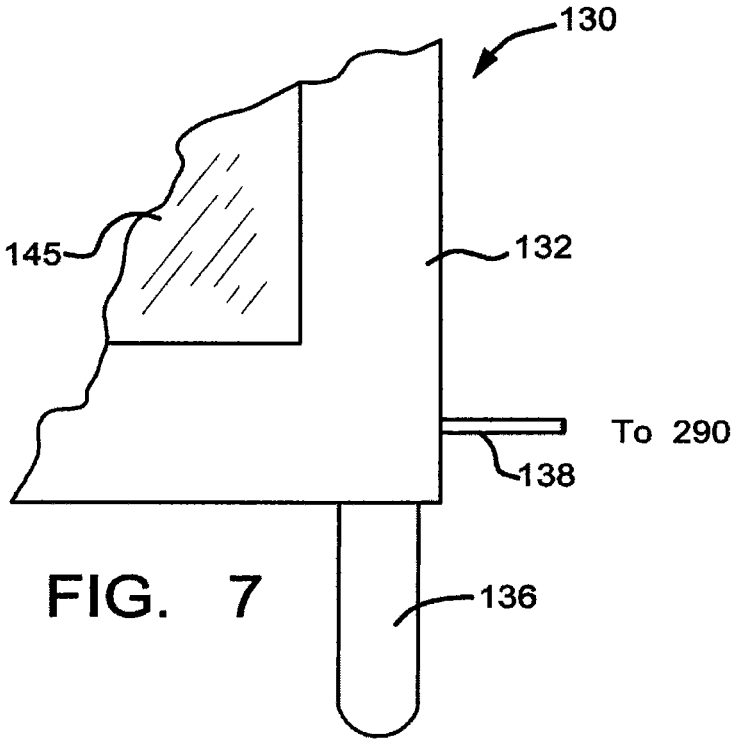
FIG. 7 is an elevation view of a bottom corner of a slider panel with a frame, pin, and cable that is disposed onto the frame in accordance with the present invention.

FIG. 7 illustrates a bottom corner of a sliding panel assembly 130 having a frame 132, pin 136, and cable 138 that is disposed directly into the frame 132. The cable 138 may be disposed by connecting means such as screw attachment, adhesive bonding, welding, and molding (not shown but common in the art). The cable 138 is in intimate contact with the frame 132. The sliding panel assembly 130 also comprises a sliding panel 145 (comprised, for example, of glass or plastic), which together with the frame 132 defines a plane. The frame 132 cooperates with the cable 138 to allow for smooth pulling of the sliding panel assembly 130 to the right by the cable 138, which is attached to the drive unit 290 and pulleys 292, 294. The cable 138 is in the plane of the sliding panel 145 and the frame 132.

Figure 8:
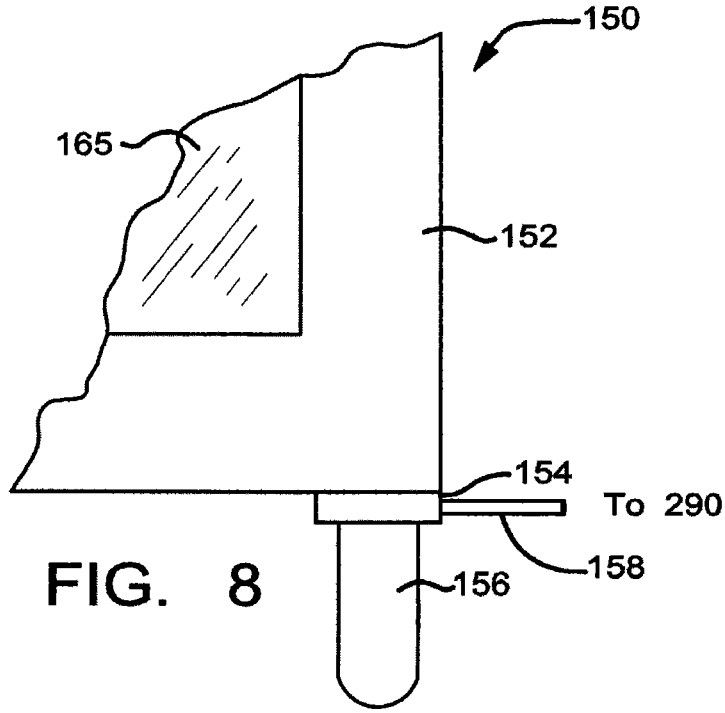
FIG. 8 is an elevation view of a bottom corner of a sliding panel with a frame, washer, pin, and cable that is disposed onto the washer in accordance with the present invention.

FIG. 8 illustrates a bottom corner of a sliding panel assembly 150 having a frame 152, shoulder or washer 154, pin 156, and cable 158 that is disposed into the washer 154. The cable 158 is in intimate contact with the washer 154. The sliding panel assembly 150 also comprises a sliding panel 165, which together with the frame 152 defines a plane. The washer 154, which is disposed on the frame 152 at the top of the pin 156, cooperates with the cable 158 to smoothly allow for pulling the sliding panel assembly 150 to the right by the cable 158, which is attached to the drive unit 290 and pulleys 292, 294. The cable 158 is in the plane of the sliding panel 165 and the frame 152.

Figure 9:
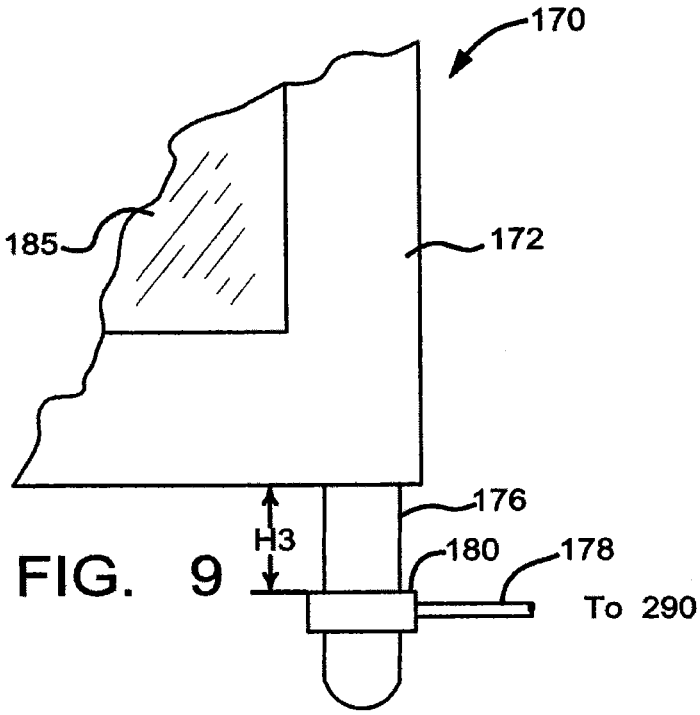
FIG. 9 is an elevation view of a bottom corner of a sliding panel with a frame, pin, collar, and cable that is disposed onto the collar in accordance with the present invention.

FIG. 9 illustrates a bottom corner of a sliding panel assembly 170 having a frame 172, pin 176, collar 180, and cable 178, which cable 178 may be disposed onto the collar 180, by connecting means such as screw attachment, adhesive bonding, welding, and molding (not shown but common in the art). The cable 178 is in intimate contact with the collar 180. The sliding panel assembly 170 also comprises a sliding panel 185 (comprised, for example, of glass or plastic), which defines a plane. The collar 180 cooperates with the cable 178 to allow for smooth pulling of the sliding panel assembly 170 to the right by the cable 178, which is attached to the drive unit 290 and pulleys 292, 294.

In FIG. 9, a dimension H3 represents the clearance necessary below the frame 172 so that the cable 178 and collar 180 do not interfere with a track (see example tracks 282, 284 of FIG. 14) during the cable's operation of pulling the sliding panel assembly 170. Similarly, clearance H3 is also present in the embodiment of FIG. 11. The cable 178 is in the plane of the sliding panel 185 and the frame 172.

Figure 10:
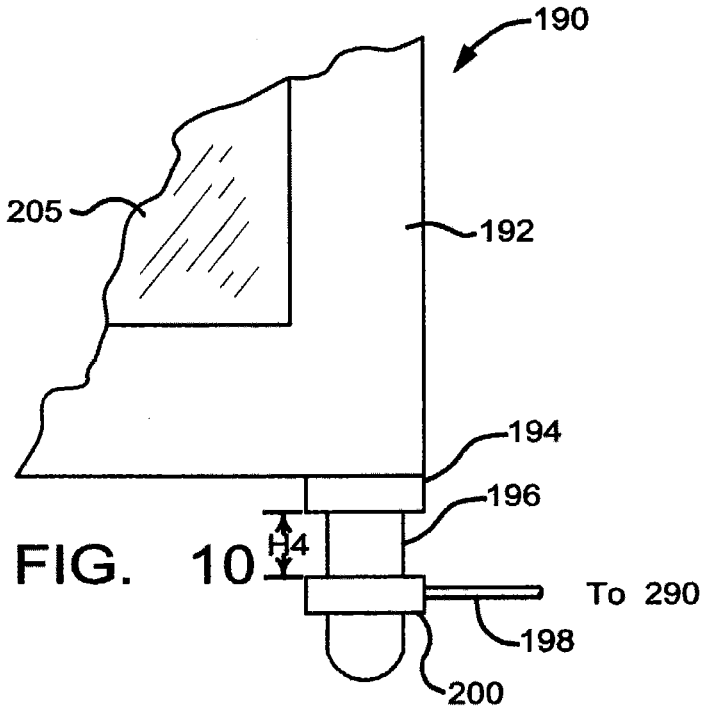
FIG. 10 is an elevation view of a bottom corner of a sliding panel with a frame, pin, washer, collar, and cable that is disposed onto the collar in accordance with the present invention.

FIG. 10 illustrates a bottom corner of a sliding panel assembly 190 having a frame 192, shoulder or washer 194, pin 196, collar 200, and cable 198 that is disposed onto the collar 200. The cable 198 is in intimate contact with the collar 200. The sliding panel assembly 190 also comprises a sliding panel 205, which together with the frame 192 defines a plane. The collar 200 cooperates with the cable 198 to allow for smooth pulling of the sliding panel assembly 190 to the right by the cable 198, which is attached to the drive unit 290 and pulleys 292, 294.

In FIG. 10, a dimension H4 represents the clearance necessary between the washer 194, which is disposed on the frame 192 at the top of the pin 196, and the collar 200 so that the cable 198 and collar 200 do not interfere with a track (see, for example, tracks 282, 284 of FIG. 14) during the cable's operation of pulling the sliding panel assembly 190. Similarly, clearance H4 is also present in the embodiment of FIG. 12. The cable 198 is in the plane of the sliding panel 205 and the frame 192.

Figure 11:
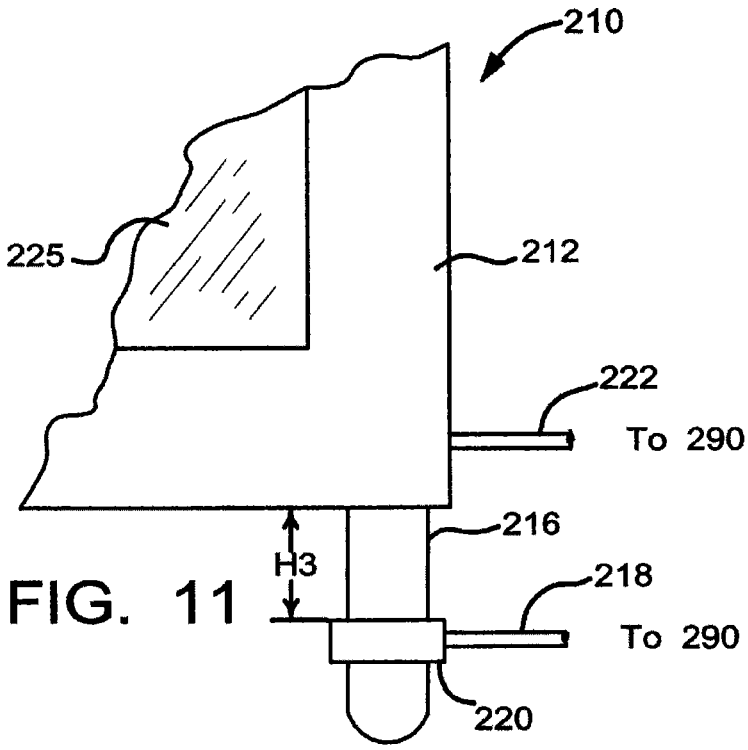
FIG. 11 is an elevation view of a bottom corner of a sliding panel with a frame, pin, collar, and two cables where one cable is disposed onto the frame and the other cable is disposed onto the collar in accordance with the present invention.

FIG. 11 illustrates a bottom corner of a sliding panel assembly 210 having a frame 212, pin 216, collar 220 with a cable 218 disposed thereon, and cable 222 that is disposed onto the frame 212. The cables 218, 222 may be disposed by connecting means such as screw attachment, adhesive bonding, welding, and molding. The cables 218, 222 are respectively in intimate contact with the collar 220 or frame 212. The sliding panel assembly 210 also comprises a sliding panel 225, which together with the frame 212 defines a plane.

The collar 220 cooperates with the cable 218 and the frame 212 cooperates with the cable 222 to allow for more smoothly pulling of the sliding panel assembly 210 to the right by the cables 218, 222 which are attached to the drive unit 290 and pulleys 292, 294. It has herein been found that by utilizing both cables 218, 222 in such a manner provides a more uniform and balanced pull force on the sliding panel assembly 210. The cables 218, 222 are in the plane of the sliding panel 225 and the frame 212.

Figure 12:
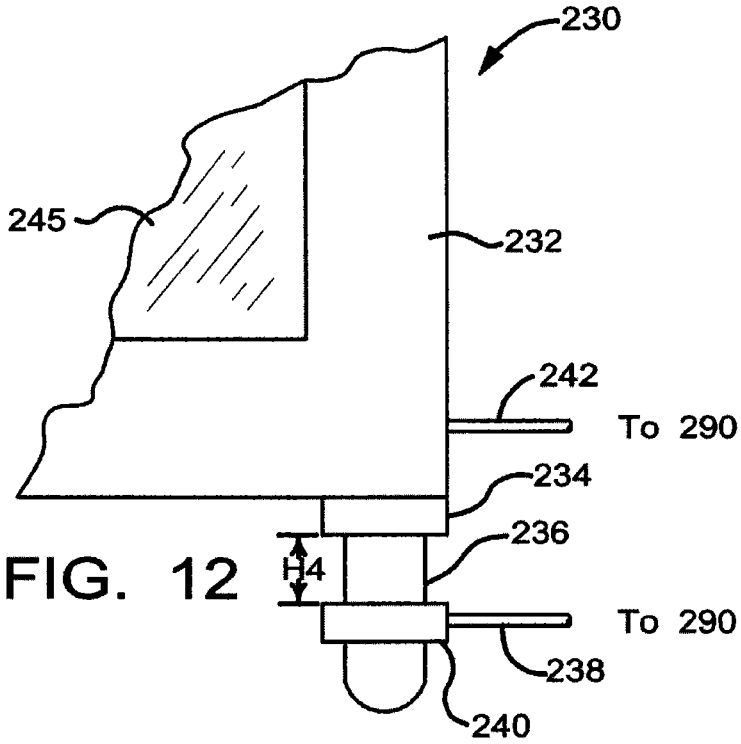
FIG. 12 is an elevation view of a bottom corner of a sliding panel with a frame, pin, washer, collar, and two cables where one cable is disposed onto the frame and the other cable is disposed onto the collar in accordance with the present invention.

FIG. 12 illustrates a bottom corner of a sliding panel assembly 230 having a frame 232, shoulder or washer 234, pin 236, collar 240 with a cable 238 that is disposed thereon, and cable 242 that is disposed onto the frame 232 at the top of the pin 236. The cables 238, 242 may be disposed by connecting means such as screw attachment, adhesive bonding, welding, and molding. The cables 238, 242 are respectively in intimate contact with the collar 240 or frame 232. The sliding panel assembly 230 also comprises a sliding panel 245, which together with the frame 232 defines a plane.

The collar 240 cooperates with the cable 238 and the frame 232 cooperates with the cable 242 to allow for more smoothly pulling of sliding panel assembly 230 to the right by the cables 238, 242 which are attached to the drive unit 290 and pulleys 292, 294. It has herein been found that by utilizing both cables 238, 242 in such a manner provides a more uniform and balanced pull force on the sliding panel assembly 230. The cables 238, 242 are in the plane of the sliding panel 245 and the frame 232.

Figure 13:
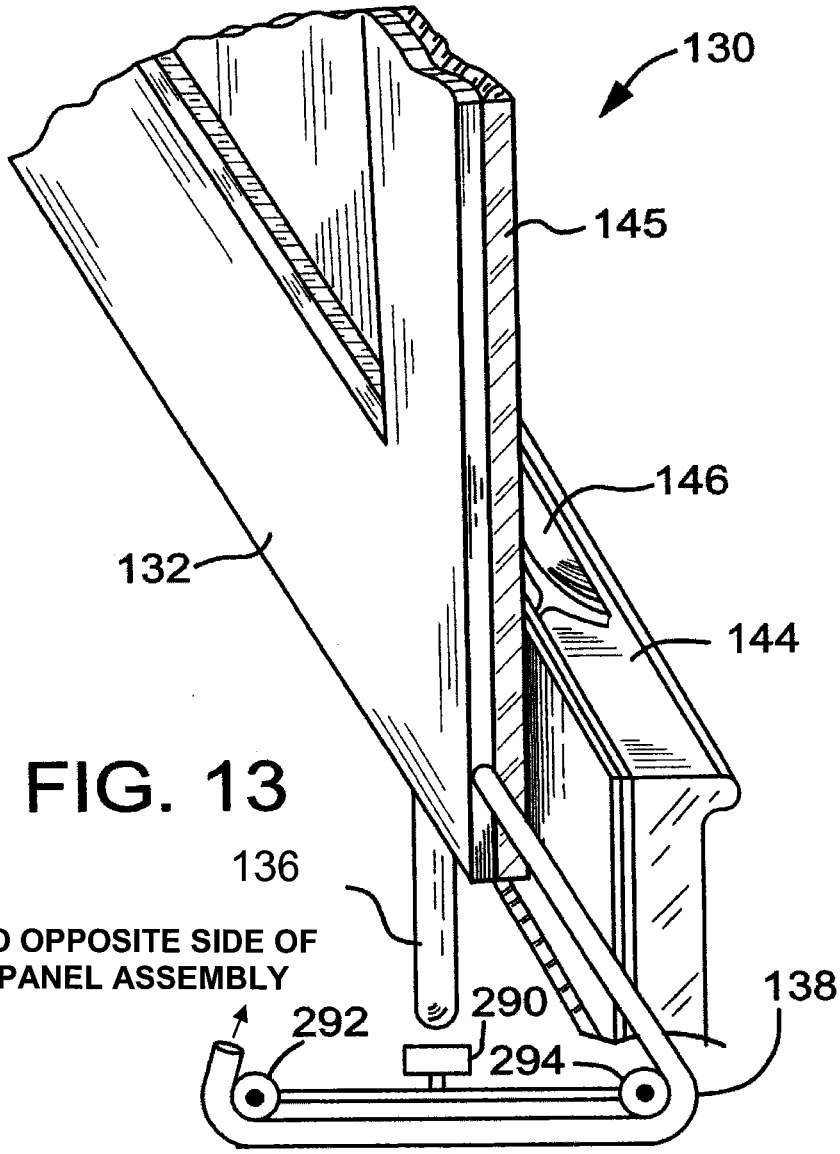
FIG. 13 is a perspective side view of the bottom corner of the sliding panel of FIG. 7 with a power drive, external body panel, and seal.

FIG. 13 illustrates a side perspective view of a possible embodiment of the sliding panel assembly 130 of FIG. 7. In this embodiment of FIG. 13, the frame 132, pin 136, cable 138, and sliding panel 145, cooperate with a vehicle body panel 144 and external seal 146 to seal a fixed panel opening 313 (see FIG. 15) from an intrusion of moisture from the exterior of a vehicle (see vehicle 25 in FIG. 7 of Seiple). FIG. 13 illustrates the cable 138 attached to the frame 132, which would look similar in a side view for cables 18, 38, 58, 78, 98, 118, 122, 138, 158, 178, 198, 218, 222, 238, and 242 to their respective frames, washers, and collars. The cable 138 is shown attached to the power drive unit 290, by way of pulleys 292, 294, which is capable of providing reciprocating movement of the sliding panel back and forth across a window opening (see, for example, fixed panel opening 313, as seen FIG. 15). Examples of the power drive unit 290 with pulleys 292, 294 are units produced by Grand Rapids Controls of Grand Rapids, Mich.

Although the above descriptions of FIGS. 1-13 involve a single lower right corner of the sliding assemblies 10, 30, 50, 70, 90, 110, 130, 150, 170, 190, 210, 230, the same descriptions apply to a lower left corner of the sliding assemblies 10, 30, 50, 70, 90, 110, 130, 150, 170, 190, 210, 230, which assemblies would reciprocally be pulled from left to right, and then be pulled from right to the left by the drive unit 290, for opening and closing a fixed panel opening.

To summarize, the powered slider panel assemblies 10, 30, 50, 70, 90, 110, 130, 150, 170, 190, 210, 230 of the present invention have a sliding panel 25, 45, 65, 85, 105, 125, 145, 165, 185, 205, 225, 245, 285 that defines a window opening (like opening 313) and a sliding panel 10, 30, 50, 70, 90, 110, 130, 150, 170, 190, 210, 230 that is movable between a closed position covering the window opening 313 and an open position, where the sliding panel has a frame member 12, 32, 52, 72, 92, 112, 132, 152, 172, 192, 212, 232, 272, 314 secured around at least a portion of the periphery of the sliding panel, and the sliding panel along with a frame defines a plane. There is at least one guide pin 16, 36, 56, 76, 96, 136, 156, 176, 196, 216, 276*a-d* extending substantially vertically downwardly from a portion of the frame member which is disposed on a bottom portion of the sliding panel and there is at least one cable 18, 38, 58, 78, 98, 102, 118, 122, 138, 158 178, 198, 222, 218, 242, 238, 278*a-d* connected at a first end to the guide pin, to the frame member, or to both, and a second end of the cable is connected to the sliding panel drive unit 290, wherein at least the first end of the cable is in the plane of sliding panel 10, 30, 50, 70, 90, 110, 130, 150, 170, 190, 210, 230, which includes the corresponding frame member.

Figure 14:
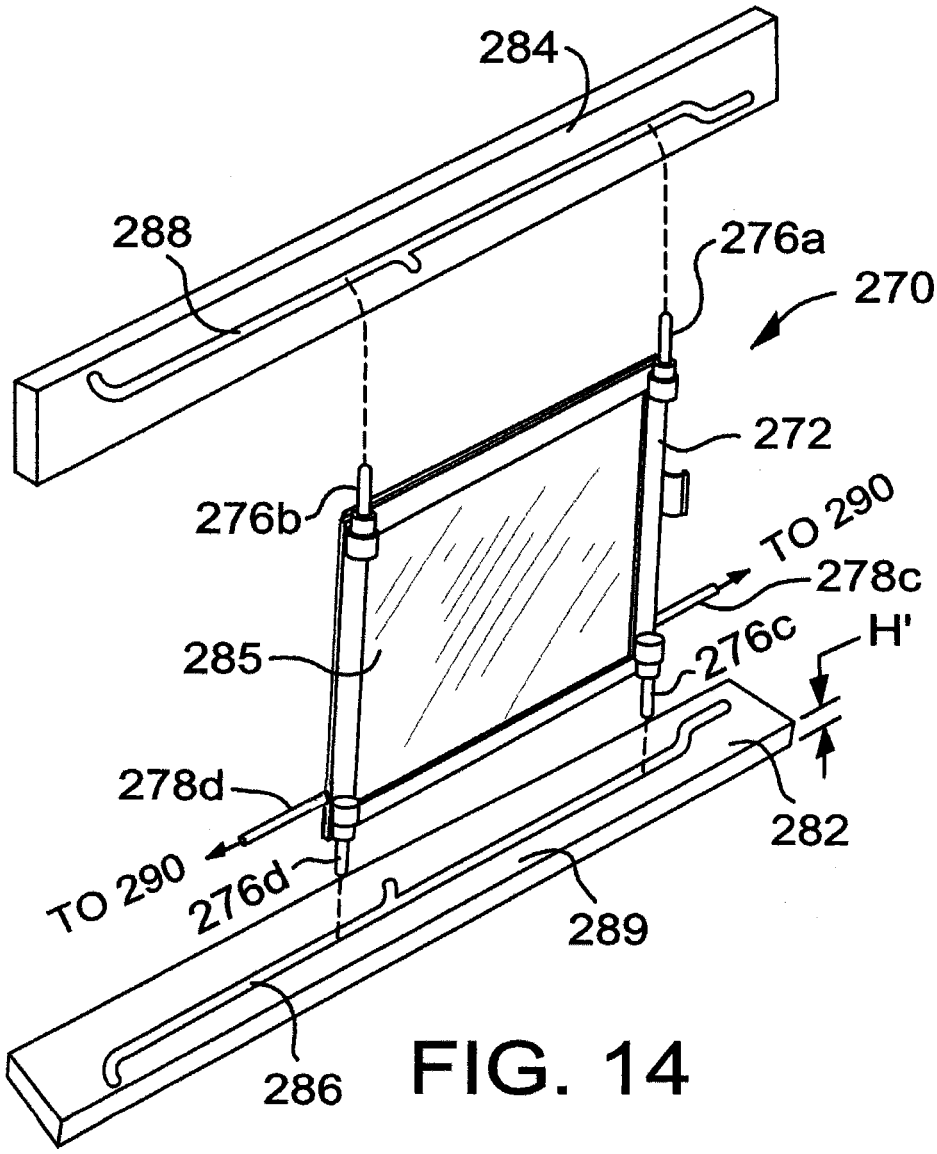
FIG. 14 is a perspective view of a sliding panel with upper and lower tracks in accordance with the present invention.

The above described sliding assemblies 10, 30, 50, 70, 90, 110, 130, 150, 170, 190, 210, 230 may be operated as a vehicle window assembly that could be categorized as non-flush, flush, or flush-flush. With regard to a flush-flush vehicle window assembly, FIG. 14 shows a sliding assembly 270 with all four corners being capable of being operated as a flush-flush sliding panel assembly 270 having a frame 272, four pins 276*a-d*, two cables 278*c,d* (for bidirectional control by the drive unit 290), and a sliding panel 285. In addition, there are two tracks 282, 284 that have respective paths 286, 288 disposed within. The cables 278*c,d* may be connected to the frame 272 or any of the pins 276*a-d*. For the sliding panel assembly 270, the pins 276 are required to be longer than those in the Seiple device, in order to extend through the corresponding tracks 282, 284.

It is noteworthy that the paths 286, 288 are different than those of Seiple, which are illustrated in Seiple's FIG. 15 as paths 328, 329, wherein the present invention paths 286, 288 are connected together, while the paths 328, 329 (with corresponding upper paths that are not shown but similar to paths 28*a*, 29*a* of Seiple) are separate from one another. Both sets of paths 286, 288 and 328, 329, however, are capable of positioning the sliding panel assemblies 10, 30, 50, 70, 90, 110, 130, 150, 170, 190, 210, 230, 270 into a flush-flush orientation.

The pins 16, 36, 56, 76, 96, 136, 156, 176, 196, 216, with or without washers 34, 74, 114, 154, 194, 234, slide similarly as the various pins of Seiple. If the pins 276*a-d* are longer than a thickness H' (see FIG. 14) of the tracks 282, 284, while in the order of the dimensions H1-H4 that are illustrated in FIGS. 3-6, 11 and 12, then the pins 276*a,b,c,d* may accommodate the washers 74, 114, 194, 234 and collars 178, 200, 220, 240, thereby allowing the cables 58, 78, 102, 122, 178, 198, 218, 238 to function as intended.

Hence, the present invention provides powered sliding assemblies that directly and smoothly drive sliding panel assemblies having little noise. While achieving these benefits, such powered sliding assemblies are simple in design, thereby having few parts which reduce material and labor costs. The few parts being realized in the present invention is a result of directly attaching the sliding panel assemblies 10, 30, 50, 70, 90, 110, 130, 150, 170, 190, 210, 230, 270 to the drive unit 290, via the pulleys 292, 294. In the case of the prior art powered sliding assemblies, the cables are directly attached to a separate device like Lin's carrier block, which in turn indirectly attaches to an attachment block that is connected to a sliding panel assembly.

In addition, the sliding panel assemblies 10, 30, 50, 70, 90, 110, 130, 150, 170, 190, 210, 230, 270 of the present invention can be incorporated into the flush-flush track and path design of the Seiple patent. FIG. 15 of the present invention is essentially prior art FIG. 1 of Seiple, where a horizontal vehicle sliding window assembly 310 comprises two fixed panels 311, 312 with the window opening 313 therebetween.

An opening frame 314 defines the window opening 313 and upper and lower tracks 315, 316 are disposed respectively above and below the window opening 313. Shown in the lower track 316 are separate paths 328, 329 that can locate the sliding panel assemblies 10, 30, 50, 70, 90, 110, 130, 150, 170, 190, 210, 230, 270 of the present invention into a flush-flush position with respect to the fixed panels 311, 312 and the vehicle body panel 144 (see FIG. 13). Although hidden from view, there are equivalent paths in the upper track 315 as FIG. 2 of Seiple illustrates. Consequently, the sliding panel assemblies 10, 30, 50, 70, 90, 110, 130, 150, 170, 190, 210, 230, 270 of the present invention can take advantage of the prior art structure of the flush-flush horizontal vehicle sliding window assembly 310.

With the washers 34, 74, 114, 154, 194, 234 installed on the pins 36, 76, 116, 156, 196, 236, as illustrated in FIGS. 2, 4, 6, 8, 10, 12, the sliding panel assemblies 30, 70, 110, 150, 190, 230 can slide across the surface 289 of the track 282 and a surface 318 of the track 316 smoothly, with less resistance, and reduced noise being generated.

Figure 16:
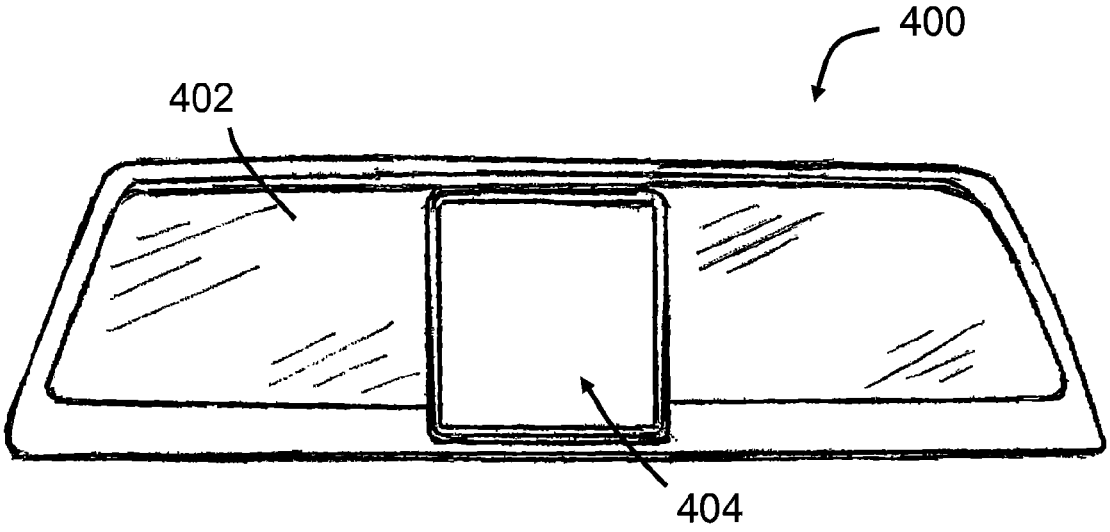
FIG. 16 is an elevation view of a single fixed panel assembly in accordance with the present invention.

Also, the sliding panel assemblies 10, 30, 50, 70, 90, 110, 130, 150, 170, 190, 210, 230, 270 of the present invention can be incorporated into a single fixed panel assembly 400, as shown in FIG. 16. The single fixed panel assembly 400 has a single fixed panel 402 with a window opening 404, where anyone of the sliding panel assemblies 10, 30, 50, 70, 90, 110, 130, 150, 170, 190, 210, 230, 270 is movable on tracks, for example, tracks 282, 284, 315, 316, between a closed position covering the window opening 404 and an open position. The single fixed panel assembly 400 cooperates with a frame member, for example, frames 12,32, 52, 72, 92, 112, 132, 212, 232, 272, secured around at least a portion of the periphery of a sliding panel, for example, sliding panels 25, 45, 65, 85, 105, 125, 145, 165, 185, 205, 225, 245, 285.

In accordance with the provisions of the patent statutes, the principles and modes of operation of this invention have been described and illustrated in its preferred embodiments. However, it must be understood that the invention may be practiced otherwise than specifically explained and illustrated without departing from its spirit or scope.

What is claimed is:

1. A powered sliding panel assembly, comprising:

a fixed panel defining a window opening;

a sliding panel movable between a closed position covering the window opening and an open position, the sliding panel having a frame member secured around at least a portion of the periphery of the sliding panel, and the sliding panel defining a plane;

at least one guide pin extending substantially vertically downwardly from a portion of the frame member, the guide pin being disposed on a bottom portion of the sliding panel; and at least one cable connected at a first end thereof to one of the group consisting of the guide pin, the frame member, and both the guide pin and the frame, and connected at a second end thereof to a sliding panel drive unit, at least the first end of the cable being in the plane of the sliding panel.

2. The powered sliding drive assembly of claim 1, wherein the guide pin is positioned in at least one track, and the sliding panel is capable of being located in a flush-flush position with the fixed panel and a vehicle body panel.

3. The powered sliding drive assembly of claim 1, wherein the guide pin has a washer disposed thereon.

4. The powered sliding drive assembly of claim 1, further comprising a collar disposed on the guide pin, wherein the cable is connected to the collar.

5. The powered sliding drive assembly of claim 1, wherein the cable has a bead intimately connected on an end thereof, and the bead is disposed within a cavity of the frame.

6. The powered sliding drive assembly of claim 5, wherein the guide pin has a washer disposed about a top thereof.

7. The powered sliding drive assembly of claim 1, wherein the cable has a bead intimately connected on an end thereof, and the bead is disposed within a cavity of the guide pin that is separated from a bottom of the frame by a dimension of H1.

8. The powered sliding drive assembly of claim 7, further comprising a track having a thickness of H', wherein H1 is greater than H'.

9. The powered sliding drive assembly of claim 7, wherein a second cable has a second bead intimately connected on an end thereof, and the second bead is disposed within a cavity of the frame.

10. The powered sliding drive assembly of claim 1, wherein the cable has a bead intimately connected on an end thereof, and the bead is disposed within a cavity of the guide pin, and the guide pin has a washer disposed about a top thereof that is separated from the cable by a dimension of H2.

11. The powered sliding drive assembly of claim 10, further comprising a track having a thickness of H', wherein H2 is greater than H'.

12. The powered sliding drive assembly of claim 10, wherein a second cable has a second bead intimately connected on an end thereof, and the second bead is disposed within a cavity of the frame.

13. The powered sliding drive assembly of claim 1, wherein the cable is directly and intimately connected on an end thereof to the frame.

14. The powered sliding drive assembly of claim 1, wherein the guide pin has a washer disposed about a top of the guide pin and the cable is directly and intimately connected on an end thereof to the washer.

15. The powered sliding drive assembly of claim 1, further comprising a collar disposed on the guide pin, wherein the cable is directly and intimately connected on an end thereof to the collar, and the collar is separated from a bottom of the frame by a dimension of H3.

16. The powered sliding drive assembly of claim 15, further comprising a track having a thickness of H', wherein H3 is greater than H'.

17. The powered sliding drive assembly of claim 15, wherein the guide pin has a washer disposed about a top thereof, and the washer is separated from the collar by a dimension of H4.

18. The powered sliding drive assembly of claim 17, further comprising a track having a thickness of H', wherein H4 is greater than H'.

19. The powered sliding drive assembly of claim 18, wherein the guide pin has a washer disposed about a top thereof, and the washer is separated from the collar by a dimension of H4.

20. The powered sliding drive assembly of claim 15, further comprising a second cable directly and intimately connected on an end thereof to the frame.

21. The powered sliding drive assembly of claim 20, further comprising a track having a thickness of H', wherein H4 is greater than H'.

22. The powered sliding drive assembly of claim 1, wherein the fixed panel comprises a single fixed panel.

23. The powered sliding drive assembly of claim 1, wherein the fixed panel comprises two separate fixed panels.

* * * * *